United States Patent [19]

Wardlaw

[11] Patent Number: 4,995,651

[45] Date of Patent: Feb. 26, 1991

[54] RELEASE MECHANISM AND METHOD

[75] Inventor: Russell Wardlaw, San Rafael, Calif.

[73] Assignee: The Cookson Company, San Francisco, Calif.

[21] Appl. No.: 444,820

[22] Filed: Dec. 1, 1989

[51] Int. Cl.[5] ..... E05B 47/00

[52] U.S. Cl. ..... 292/201; 292/DIG. 36; 292/336.3

[58] Field of Search ..... 160/209, 170, 133; 292/201, 336.3, 92, 144, 345, DIG. 36

[56] References Cited

U.S. PATENT DOCUMENTS

| | | | |
|---|---|---|---|
| 2,327,778 | 8/1943 | Ferris et al. | 292/DIG. 36 X |
| 2,607,586 | 8/1952 | Schlytern | 292/201 X |
| 3,309,664 | 3/1967 | Deutsch et al. | 292/144 X |
| 3,426,829 | 2/1969 | McDaniel et al. | 160/209 X |
| 3,576,119 | 4/1971 | Harris | 292/144 X |
| 3,955,840 | 5/1976 | Rawls et al. | 292/201 X |

*Primary Examiner*—Richard E. Moore

*Attorney, Agent, or Firm*—Flehr, Hohbach, Test, Albritton & Herbert

[57] ABSTRACT

Release mechanism and method for fire doors and the like. The door is normally held in an open position by an electrically energized actuator and is released for closing upon deenergization of the actuator. An energizing current is supplied to the actuator from a source to energize the actuator, and a limited amount of energy from the source is stored in an element such as a capacitor. Upon interruption of the current from the source to the actuator, the actuator is energized with the stored energy to prevent the door from closing for a limited period of time after the current is interrupted.

7 Claims, 2 Drawing Sheets

RELEASE MECHANISM AND METHOD

This invention pertains generally to release mechanisms for fire doors and the like and, more particularly, to a release mechanism and method in which the closing of a door is delayed for a preset period of time after the occurrence of the event which initiates the closing.

Fire doors and other closures are commonly provided with release mechanisms which hold the doors or closures in an open position and release them for movement to a closed position in response to an event such as the actuation of a fire alarm or a smoke detector. Such systems usually receive operating power from the electrical system of the building in which they are installed, and a loss of operating power can also cause the mechanism to be released.

Fire alarms and smoke detectors are tested periodically to assure that they are in proper working order. In instances where power interruption is momentary, such as from a power surge when lightening strikes, in order to prevent all of the fire doors or other closures in a building from closing and having to be reset, some release mechanisms are designed to delay the closing of the doors or closures for a period of time sufficient to permit the power to be restored.

U.S. Pat. No. 4,130,156 discloses a release mechanism having a normally energized solenoid and a dashpot which controls the rate of movement of a portion of the mechanism to delay the release of the door following deenergization of the solenoid. The dashpot has an adjustable vent opening which can be set to provide the desired delay. This system is a "fail-safe" system.

U.S. Pat. 3,955,840 discloses a release mechanism in which a time delay device is connected electrically in series with a normally deenergized solenoid coil to delay completion of the energizing circuit for the solenoid and thereby prevent undesirable actuation of the release mechanism should there be a false short-term application of power to the circuit which would otherwise energize the coil and actuate the mechanism. This is a non-fail-safe system and would not meet the standards of the fire codes for use in public buildings such as hospitals and the like.

It is in general an object of the invention to provide a new and improved release mechanism and method for fire doors and the like.

Another object of the invention is to provide a release mechanism and method of the above character in which actuation is delayed to permit momentary interruption and restoration of operating power before a door controlled by the mechanism is released.

These and other objects are achieved in accordance with the invention by holding a release member in a holding position with an electrically energized actuator, supplying an energizing current to the actuator from a source to energize the actuator, storing a limited amount of energy from the source in an element such as a capacitor, interrupting the delivery of current from the source to the actuator, and energizing the actuator with the stored energy to prevent release of the retaining member for a limited period of time after the current is interrupted.

Figure 1:
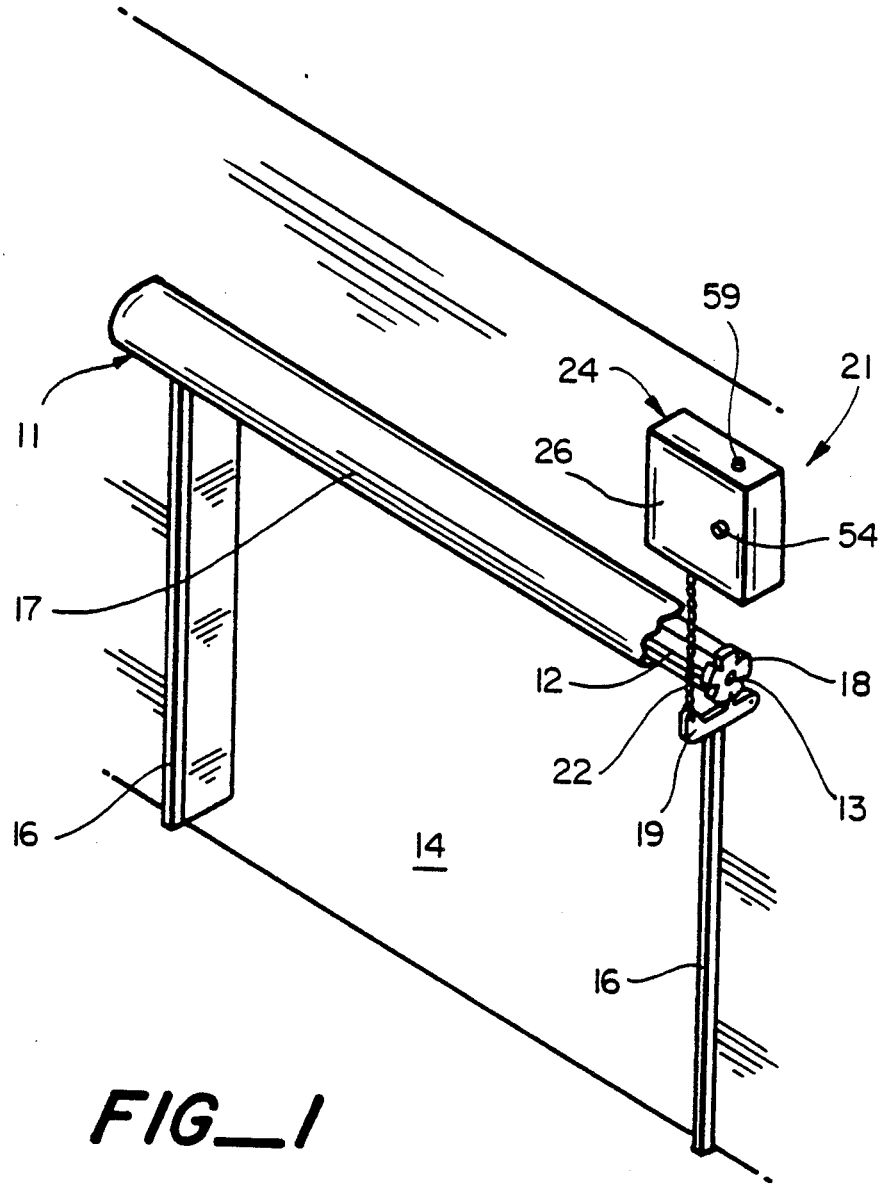
FIG. 1 is an isometric view, partly broken away and somewhat schematic, of one embodiment of a rolling fire door assembly with a release mechanism according to the invention.

In FIG. 1, the invention is illustrated in connection with a rolling fire door assembly 11. This assembly includes a door 12 which is mounted on a horizontally extending axle 13 above a door opening 14 for movement between raised (open) and lowered (closed) positions. Vertically extending guide rails 16 guide the edges of the door at the sides of the opening. The door is rolled about the axle and tends to unwind from the axle and drop to the closed position by its own weight. The axle is enclosed within a housing 17 which also covers the door when it is in its rolled up or raised position.

Movement of the door toward the closed position is counterbalanced by a coil torsion spring (not shown) mounted within the barrel upon which the rolling door wraps. For example, see U.S. Pat. No. 3,637,004 by the present inventor. A detent wheel 18 is affixed to the axle 13 and a release lever 19 is pivotally mounted for movement into and out of locking engagement with the wheel. Unless held in the locking position, the release lever 19 tends to drop out of engagement with the wheel 18 and permit the axle 13 to rotate and the door 12 to move toward the closed position.

The door is held in the raised position by a release mechanism 21 which is mounted on the wall above the housing. The release mechanism is connected to release lever 19 by a chain or cable 22 in such manner that the release lever is held in locking engagement with detent wheel when the chain is in tension, i.e, when the upper end of the chain is held by the release mechanism. The chain includes a fusible link which is adapted to melt and thereby release the door in response to the heat produced by a fire.

The release mechanism is enclosed within a generally rectangular housing 24 having a front cover 26, a rear panel 27, a top panel 28, a bottom panel 29 and side panels 31, 32, with mounting lugs 33 affixed to the top and bottom panels.

Figure 2:
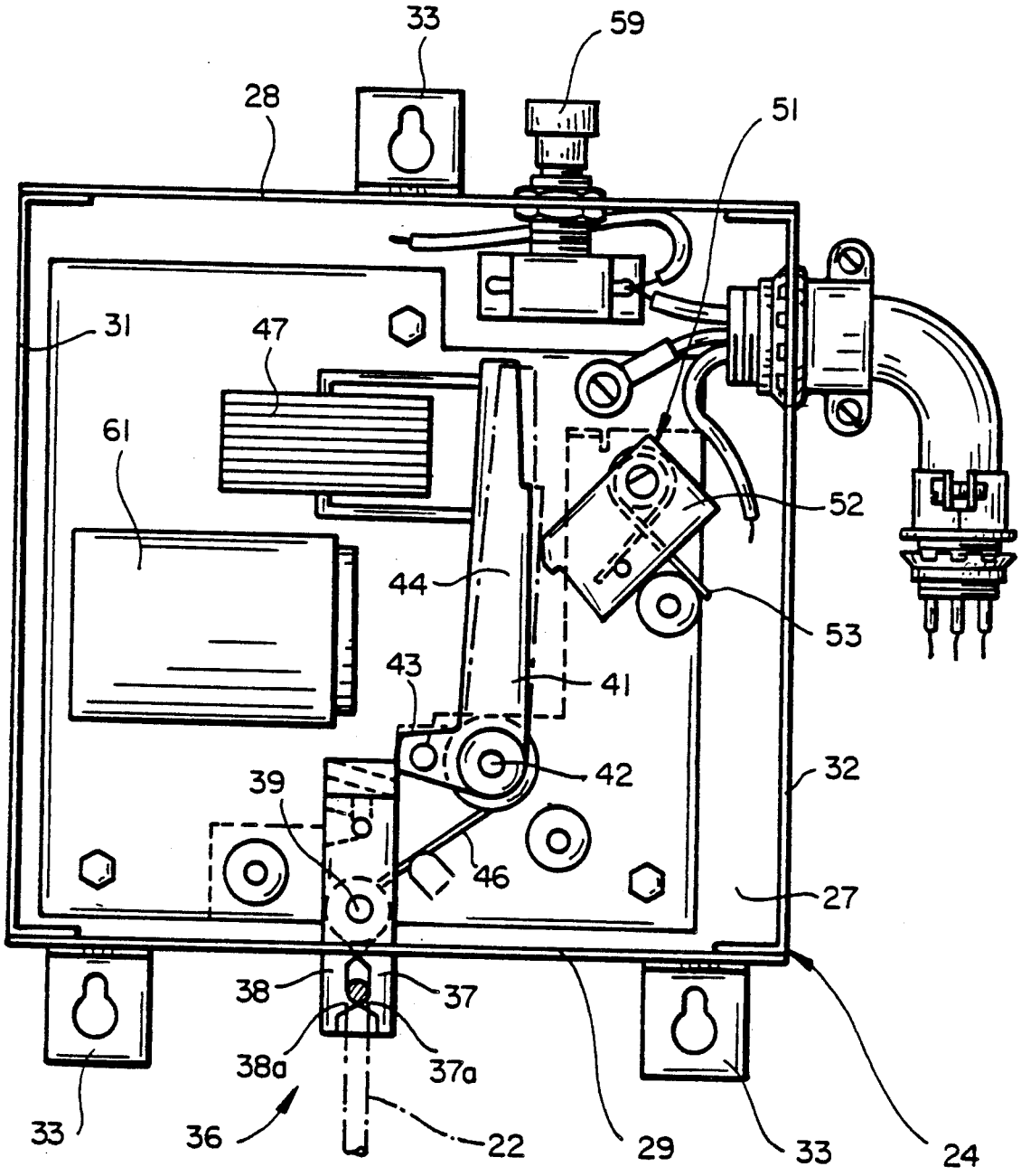
FIG. 2 is a plan view of the release mechanism in the embodiment of FIG. 1.

The release mechanism includes a hook assembly 36 which releasably engages the uppermost link of chain 22 to hold the door in the open position. This assembly comprises a pair of stationary parts 37 and a movable part 38 which extend through an opening in the bottom panel of housing 24. The two stationary parts are identical, and they are spaced apart and aligned in registration with each other. The movable part is positioned between the stationary parts and is mounted on a shaft 39 for pivotal movement between open and closed positions relative to the stationary parts. The hook parts have finger portions **37*a*, 38*a* which face each other and intermesh to capture the chain when the hook assembly is in a closed or holding position. This is the position in which the assembly is shown in FIG. 2. When the movable part pivots in a clockwise The hook assembly is held in the closed position by an L-shaped release lever 41 which is pivotally mounted on a shaft 42 for movement into and out of engagement with the movable hook part 38. The lever has a relatively short lower arm 43 and a longer upper arm 44. In the holding position, the outer end of lower arm 43 abuts against the upper portion of hook part 38 and thus holds the hook assembly in its closed position. When lever 41 rotates in a clockwise direction, as viewed in FIG. 2, arm 43 moves clear of hook part 38, and the hook part is free to move to its open position. The lever is urged toward this tripped position by a spring 46**.

Means is provided for retaining release lever 41 in its latched or holding position with arm 43 in engagement with hook part 38. This means includes an electrically energized holding coil 47 which draws the upper portion of lever arm 44 toward the left by magnetic attraction when energized. The lever is illustrated in full lines in its latched or holding position in FIG. 2. When the holding coil is deenergized, spring 46 rotates the lever in a clockwise direction to the tripped position which is shown in broken lines in FIG. 2. Alternatively, the unit 47 can comprise a solenoid, the movable armature of which is connected to the upper portion of the lever arm 44.

In one presently preferred embodiment, the entire release lever 41 is fabricated of a magnetically conductive material. However, it is only necessary to have the magnetic material near the coil, and the lever can be constructed accordingly, e.g. by fabricating only the upper portion of arm 44 of magnetic material or by attaching a piece of magnetic material to the upper portion of the arm.

A manually operated cam assembly 51 is provided for resetting lever 41 from the tripped position to the latched position. This assembly includes a pivotally mounted eccentric block 52 which is urged in a counterclockwise direction away from the upper arm 44 of the lever by a spring 53. A knob 54 connected to the cam block is positioned outside the front cover of enclosure 24 to provide means for manually rotating the block in the clockwise direction against the force of spring 53 to return the lever to the holding position.

Figure 3:
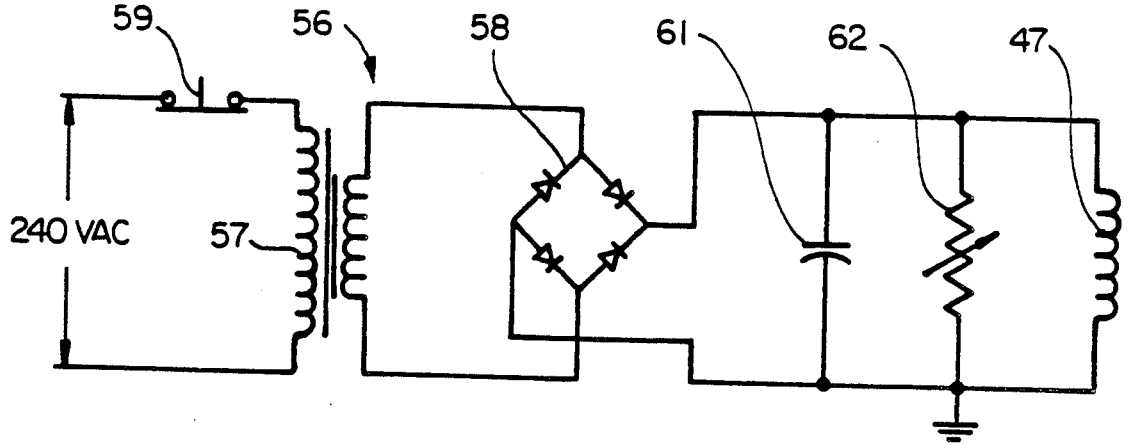
FIG. 3 is a circuit diagram of the release mechanism in the embodiment of FIG. 1.

Coil 47, (or solenoid 47), is energized from the electrical service for the building in which the door is located through a power supply 56. This supply is illustrated in simplified form in FIG. 3 as having a transformer 57 connected to the a.c. supply lines and a rectifier bridge 58 connected to the secondary winding of the transformer. The output of the bridge is connected to coil 47, and a normally closed test switch 59 is connected in series with one of the supply lines to the transformer. This switch is mounted on the upper panel of housing 24 and has a manually operable pushbutton which is accessible outside the housing. In normal operation, the power supply is energized and coil 47 receives an energizing current from the supply. A suitable switching device (not shown) can be connected to the circuit to interrupt the current to the coil in response to a signal from a fire alarm, a smoke detector, or other signalling device.

Means is provided for delaying deenergization of the holding coil for a predetermined period of time following interruption of the energizing current from the power supply. This means includes a capacitor 61 which is connected electrically in parallel with the holding coil. During normal operation of the system, the capacitor is charged with energy from the power supply. Upon interruption of the power from the supply, the capacitor continues to supply operating current to the coil to keep the coil energized until the charge on the capacitor drops below the level required to hold the release lever against the force of spring 46. When the unit 47 comprises a solenoid, the capacitor continues to supply operating current to the solenoid coil to keep the coil energized until the charge on the capacitor drops below the level required to hold the shiftable armature in the solenoid against the force of the spring 46.

An adjustable resistor 62 is connected in parallel with the capacitor to provide means for controlling the rate at which the capacitor is discharged and, thus, the length of the delay. In one presently preferred embodiment, the power supply provides an output voltage on the order of 24 volts, the capacitor has a capacitance on the order of 28,000 microfarads, the coil has a resistance on the order of 160 ohms, and the resistor has a maximum resistance on the order of 50 ohms. The resistor is typically set to provide a delay on the order of 5 to 20 seconds. If desired, a fixed resistor can be utilized to provide a given delay, or the resistor can be connected in parallel with the capacitor or in series with the coil.

Operation and use of the release mechanism, and therein the method of the invention, are as follows. It is assumed that the door is initially in its rolled up or open position and that hook assembly 36 is engaged with chain 22 to hold the door in this position. Energizing current is supplied to the holding coil by power supply 56, and capacitor 61 is maintained in a charged condition by current from the supply.

Upon the interruption of current from the power supply, e.g. by actuation of the test switch 59 or upon an interruption in the building power, the holding coil is maintained in its energized state for a limited period of time by the charge which has been stored in the capacitor. This period of time is selected in accordance with the requirements of the test system for the building in which the unit is installed. Within this period of time, the alarm system is tested or the sequence for bringing emergency generator power is initiated. Assuming that the alarm test event or power switching event is completed within the delayed period, the unit will reset itself when power is again supplied to the line.

However, in the case of earthquakes, fires, or other events causing the municipal power network to shut down, the period of time for restoration permitted by this system is exceeded, and thereby the charge in the capacitor is depleted. Then the lever 44 is released, which permits the hook assembly 36 to open, thereby releasing chain 22 and permitting the door to drop to its closed position.

The system is reset by raising the door, engaging chain 22 with hook assembly 36, rotating cam assembly 51 to return lever 41 to its holding position, and reenergizing the holding coil.

The invention has a number of important features and advantages. It provides a release mechanism and method in which actuation is delayed to permit testing or restoration of operating power before a door controlled by the mechanism is released. It is reliable in operation and eliminates the need for dashpots or other mechanical devices to actuation of the mechanism.

It is apparent from the foregoing that a new and improved release mechanism and method have been provided. While only certain presently preferred embodiments have been described in detail, as will be apparent to those familiar with the art, certain changes and modifications can be made without departing from the scope of the invention as defined by the following claims.

I claim:

1. In a release mechanism: a retaining member, electrically operated means for holding the retaining member in a holding position when energized and for releasing the retaining member from the holding position when deenergized, a source for supplying an energizing current to the electrically operated means, and means connected to the source and to the electrically operated means for storing a limited amount of energy from the source and delivering an energizing current to the electrically operated means for a limited period of time after interruption of the current from the source.

2. The mechanism of claim 1 wherein the means for storing energy and delivering current to the electrically operated means comprises a capacitor.

3. In a release mechanism: a retaining member, an electrically energized coil for magnetically holding the retaining member in a holding position when energized and for releasing the retaining member from the holding position when deenergized, a source for supplying an energizing current to the coil, and a capacitor connected to the source and to the coil for storing energy from the source and delivering an energizing current to the coil for a limited period of time after interruption of the current from the source.

4. In combination: a door movable between open and closed positions, means urging the door toward its closed position, a retaining member connected to the door for holding the door in its open position, electrically operated means for holding the retaining member in a holding position when energized and for releasing the retaining member from the holding position when deenergized, a source for supplying an energizing current to the electrically operated means, and means connected to the source and to the electrically operated means for storing a limited amount energy from the source and delivering an energizing current to the electrically operated means for a limited period of time after interruption of the current from the source.

5. The combination of claim 4 wherein the means for storing energy and delivering current to the electrically operated means comprises a capacitor.

6. In method of operating a release mechanism having a retaining member and an electrically operated actuator for holding the retaining member in a holding position when energized and for releasing the retaining member from the holding position when deenergized, the steps of: supplying an energizing current to the actuator from a source to energize the actuator, storing a limited amount of energy from the source, interrupting the delivery of current from the source to the actuator, and energizing the actuator with the stored energy to prevent release of the retaining member for a limited period of time after the current is interrupted.

7. The method of claim 6 wherein the energy is stored in a capacitor connected to the actuator.

* * * * *